US005089156A

United States Patent [19]

Chrisope et al.

[11] Patent Number: 5,089,156

[45] Date of Patent: Feb. 18, 1992

[54] ASHLESS OR LOW-ASH SYNTHETIC BASE COMPOSITIONS AND ADDITIVES THEREFOR

[75] Inventors: Douglas R. Chrisope; Rolfe J. Hartley, both of St. Louis, Mo.

[73] Assignee: Ethyl Petroleum Additives, Inc., St. Louis, Mo.

[21] Appl. No.: 597,493

[22] Filed: Oct. 10, 1990

[51] Int. Cl.[5] ..... C10M 133/44

[52] U.S. Cl. ..... 252/49.9; 585/12; 252/51.5 A

[58] Field of Search ..... 252/49.9; 585/12

[56] References Cited

U.S. PATENT DOCUMENTS

| | | | |
|---|---|---|---|
| 3,697,429 | 10/1972 | Engel et al. | 585/12 |
| 3,763,244 | 10/1973 | Shubkin | 260/676 |
| 3,816,346 | 6/1974 | Coppock et al. | 252/49.9 |
| 4,036,771 | 7/1977 | Denis et al. | 252/56 |
| 4,118,329 | 10/1978 | Hotten | 252/49.9 |
| 4,282,392 | 8/1981 | Cupples et al. | 585/10 |
| 4,587,368 | 5/1986 | Pratt | 585/12 |
| 4,747,971 | 5/1988 | Erdman | 252/32.5 |
| 4,857,214 | 8/1989 | Papay et al. | 252/49.9 |
| 4,956,122 | 9/1990 | Watts et al. | 252/565 |
| 4,992,183 | 2/1991 | Beimesch et al. | 252/32.7 |

FOREIGN PATENT DOCUMENTS

| | | | |
|---|---|---|---|
| 716247 | 10/1966 | Italy | 585/12 |
| 961009 | 6/1964 | United Kingdom . | |

OTHER PUBLICATIONS

ASLE Transactions, vol. 9, No. 1, pp. 1–12, 1966.
NLGI Spokesman, Aug. 1980, pp. 168–175.
SAE Technical Paper 8211181, copyright 1982.
Affidavit dated Feb. 5, 1988 on file in an opposition against EP 88453.
Internal memorandum dated Apr. 29, 1980.
Collection of documents believed to have been received from Uniroyal at least by May 14, 1980.
"SYNTON", an undated brochure from Uniroyal.

*Primary Examiner*—Brian E. Hearn
*Assistant Examiner*—Maria Nuzzolillo
*Attorney, Agent, or Firm*—John F. Sieberth

[57] ABSTRACT

An ashless or low-ash oleaginous liquid composition comprising a major amount of hydrogenated poly-α-olefin oligomer fluid having a viscosity in the range of about 2 to about 10 cSt at 100°C., and minor amounts of at least the following: A) hydrogenated poly-α-olefin oligomer fluid having a viscosity in the range of about 40 to about 120 cSt at 100°C.; and B) antiwear/extreme pressure agent selected from phosphorus-containing ashless dispersant, boron-containing ashless dispersant, and phosphorus- and boron-containing ashless dispersant. Compositions of this type can be formed having excellent high and low temperature viscosity characteristics and excellent shear stability. To this end, the preferred compositions are devoid or substantially devoid of conventional polymeric high molecular weight viscosity index improvers.

20 Claims, No Drawings

ASHLESS OR LOW-ASH SYNTHETIC BASE COMPOSITIONS AND ADDITIVES THEREFOR

TECHNICAL FIELD

This invention relates to oleaginous liquid compositions of enhanced performance capabilities, and to additive concentrates useful in forming such compositions.

BACKGROUND

Traditionally, oleaginous liquids such as crankcase lubricants, gear oils, manual and automatic transmission fluids, oil-based hydraulic fluids, and the like have contained significant quantities of metal-containing ingredients, typically zinc dihydrocarbyl dithiophosphates and/or alkali or alkaline earth metal-containing detergents. Because of environmental and performance concerns, it is desirable to reduce or eliminate such ingredients. However, to do so requires use of non-metallic additives which contribute the necessary properties to the base oil.

Another goal desired in practice is the development of oleaginous liquid compositions based on use of synthetic base oils rather than mineral oils. However the development of such fluids necessitates the discovery of compositions having suitable viscosities at low temperatures and at high temperatures. In addition, it is desirable to provide an oleaginous liquid composition which possesses high shear stability.

THE INVENTION

This invention provides, inter alia, oleaginous liquid compositions which are devoid or essentially devoid of metal-containing components such as additives containing lithium, sodium, potassium, magnesium, calcium, strontium, barium, zinc, etc. By "essentially devoid" is meant that the overall lubricating oil or functional fluid composition contains on a weight basis no more than about 100 parts per million of such metals. The compositions of this invention do contain one or more components containing boron or phosphorus or a combination of boron and phosphorus, which elements of course are not classified as metals.

Further, this invention provides oleaginous liquid compositions wherein the base oils are composed predominantly or entirely of particular synthetic lubricants. These oleaginous fluid compositions have good low temperature and high temperature viscosity properties and possess high shear stability.

Thus, in one of its forms this invention provides an oleaginous liquid composition (preferably but not necessarily an automatic transmission fluid composition) which comprises a major amount of hydrogenated poly-α-olefin oligomer fluid having a viscosity in the range of about 2 to about 10 cSt at 100° C., and minor amounts of at least the following: A) hydrogenated poly-α-olefin oligomer fluid having a viscosity in the range of about 40 to about 120 cSt at 100° C.; and B) antiwear/extreme pressure agent selected from phosphorus-containing ashless dispersant, boron-containing ashless dispersant, and phosphorus- and boron-containing ashless dispersant, said oleaginous liquid composition being further characterized by being devoid or essentially devoid of metal-containing components and by having (i) a kinematic viscosity of at least 5.5 cSt at 100° C. and a Brookfield viscosity of less than 20,000 cP at −40° C.; or (ii) a kinematic viscosity of at least 6.8 cSt at 100° C. and a Brookfield viscosity of less than 50,000 cP at −40° C.

Most preferred are compositions of this type having a kinematic viscosity of at least 6.8 cSt at 100° C. and a Brookfield viscosity of less than 20,000 cP at −40° C.

Additional embodiments of this invention include, among others, additive concentrates capable of forming, when blended with an appropriate base oil, an oleaginous liquid composition having enhanced properties, such as the performance characteristics referred to above. Thus for example, this invention provides in one of its forms an additive concentrate comprising at least the following: A) hydrogenated poly-α-olefin oligomer fluid having a viscosity in the range of about 40 to about 120 cSt at 100° C.; and B) antiwear/extreme pressure agent selected from phosphorus-containing ashless dispersant, boron-containing ashless dispersant, and phosphorus- and boron-containing ashless dispersant; said concentrate being characterized by (i) being devoid or essentially devoid of metal-containing components, and (ii) enabling hydrogenated poly-α-olefin oligomer fluid having a viscosity in the range of about 2 to about 10 cSt at 100° C. to have (a) a kinematic viscosity of at least 5.5 cSt at 100° C. and a Brookfield viscosity of less than 20,000 cP at −40° C., or (b) a kinematic viscosity of at least 6.8 cSt at 100° C and a Brookfield viscosity of less than 50,000 cP at −40° C., when said concentrate is blended in such hydrogenated poly-α-olefin oligomer fluid at at least one concentration below 10 percent by weight. It will be understood and appreciated that, although preferably employed in oleaginous liquids consisting essentially of hydrogenated poly-α-olefin oligomer fluid where the additive-free fluid has a viscosity in the range of about 2 to about 10 cSt at 100° C., such additive concentrates can be used in other base oils. It will also be understood and appreciated that, although preferably employed at a concentration below lo percent by weight, the additive concentrates can be employed at higher concentrations in base fluids, whether composed mainly of hydrogenated poly-α-olefin oligomer or otherwise. In short, all that is required is that the concentrate possesses or is characterized by the inherent property of being able to provide an oleaginous liquid having (a) a kinematic viscosity of at least 5.5 cSt at 100° C. and a Brookfield viscosity of less than 20,000 cP at −40° C, or (b) a kinematic viscosity of at least 6.8 cSt at 100° C. and a Brookfield viscosity of less than 50,000 cP at −40° C., when said concentrate is blended at at least one concentration below 10 percent by weight in an additive-free hydrogenated poly-α-olefin oligomer fluid which, in its additive-free condition, has a viscosity in the range of about 2 to about 10 cSt at 100° C. Additive concentrates which possess or are characterized by this inherent property are thus suitable for blending with any oleaginous liquid having a viscosity in the range of about 2 to about 10 cSt at 100° C.

Among the other features of this invention is the fact that preferred compositions of this invention can achieve the foregoing viscosity parameters without use of conventional high molecular weight polymeric viscosity index improvers such as the methacrylates, acrylates, styrene copolymers, ethylene-propylene copolymers, and the like. Thus among the preferred embodiments of this invention are oleaginous liquid compositions of the various types described above which are devoid of such polymeric viscosity index improvers or which contain at most up to but no more than about 10 percent by weight of one or more such polymeric viscosity index improvers.

Another features of this invention is that it is possible to provide oleaginous liquids which have exceptionally high shear stability. This is accomplished by minimizing the amount, if any, of the high molecular weight polymeric viscosity index improver(s) present in the oleaginous liquid. Thus from the standpoint of shear stability, the lower the concentration of high molecular weight polymeric viscosity index improver, the better, and therefore, compositions that are substantially devoid of such viscosity index improver are preferred, and compositions that are completely devoid of such viscosity index improver are most preferred.

These and other embodiments and features of this invention will become still further apparent from the ensuing description and appended claims.

Base Oils

As noted above, the oleaginous liquids of this invention are compounded from base oils or fluids composed predominantly (i.e., more than 50 percent by volume) or entirely of hydrogenated poly-α-olefin oligomer fluid having a viscosity at 100° C. in the range of about 2 to about 10 cSt. Such fluids are formed by oligomerization of 1-alkene hydrocarbon having 6 to 20 and preferably 8 to 16 carbon atoms in the molecule and hydrogenation of the resultant oligomer. Hydrogenated oligomers formed from 1-decene are particularly preferred.

Methods for the production of such liquid oligomeric 1-alkene hydrocarbons are known and reported in the literature. See for example U.S. Pat. Nos. 3,763,244; 3,780,128; 4,172,855; 4,218,330; and 4,950,822. Additionally, hydrogenated 1-alkene oligomers of this type are available as articles of commerce, for example, under the trade designations HITEC® 162, HITEC® 164, HITEC® 166, HITEC® 168 and HITEC® 170 poly-α-olefin oils (Ethyl Corporation; Ethyl Petroleum Additives, Inc.; Ethyl Petroleum Additives, Ltd.). Tabulated below are data concerning typical composition and properties of these products. In these tabulations the typical compositions are expressed in terms of normalized area percentages by GC and "n.d." means "not determined".

HITEC 162 poly-α-olefin oil:

Composition—Monomer 0.4, Dimer 90.7, Trimer 8.3, Tetramer 0.6.

Properties—Viscosity at 100° C.: 1.80 cSt; Viscosity at 40° C.: 5.54 cSt; Viscosity at −18° C.: n.d.; Viscosity at −40° C.: 306 cSt; Pour point: −63° C.; Flash point (ASTM D 92): 165° C.; NOACK volatility: 99%.

HITEC 164 poly-α-olefin oil:

Composition—Trimer 82.7, Tetramer 14.6, Pentamer 2.7.

Properties—Viscosity at 100° C.: 4.06 cSt; Viscosity at 40° C.: 17.4 cSt; Viscosity at −18° C.: n.d.; Viscosity at −40° C.: 2490 cSt; Pour point: <−65° C.; Flash point (ASTM D 92): 224° C.; NOACK volatility: 12.9%.

HITEC 166 poly-α-olefin oil:

Composition—Trimer 32.0, Tetramer 43.4, Pentamer 21.6, Hexamer 3.0.

Properties—Viscosity at 100° C.: 5.91 cSt; Viscosity at 40° C.: 31.4 cSt; Viscosity at −18° C.: n.d.; Viscosity at −40° C.: 7877 cSt; Pour point: −63° C.; Flash point (ASTM D 92) 235° C.; NOACK volatility: 7.5%.

HITEC 168 poly-α-olefin oil:

Composition—Trimer 4.3, Tetramer 56.3, Pentamer 33.9, Hexamer 5.5.

Properties—Viscosity at 100° C.: 7.78 cSt; Viscosity at 40° C.: 46.7 cSt; Viscosity at −18° C.: n.d.; Viscosity at −40° C.: 18305 cSt; Pour point: −60° C.; Flash point (ASTM D 92): 254° C.; NOACK volatility: 3.5%.

HITEC 170 poly-α-olefin oil:

Composition—Dimer 0.1, Trimer 1.1, Tetramer 42.5, Pentamer 32.3, Hexamer 11.8, Heptamer 12.2.

Properties—Viscosity at 100° C.: 9.87 cSt; Viscosity at 40° C.: 64.5 cSt; Viscosity at −18° C.: 2770.; Viscosity at −40° C.: n.d.; Pour point: −54° C.; Flash point (ASTM D 92): 268° C.; NOACK volatility: 1.7%.

Suitable 1-alkene oligomers are also available from other suppliers. As is well known, hydrogenated oligomers of this type contain little, if any, residual ethylenic unsaturation. Preferred oligomers are formed by use of a Friedel-Crafts catalyst (especially boron trifluoride promoted with water or a $C_{1-20}$ alkanol) followed by catalytic hydrogenation of the oligomer so formed using procedures such as are described in the foregoing U.S. patents.

Other catalyst systems which can be used to form oligomers of 1-alkene hydrocarbons, which, on hydrogenation, provide suitable oleaginous liquids include Ziegler catalysts such as ethyl aluminum sesquichloride with titanium tetrachloride, aluminum alkyl catalysts, chromium oxide catalysts on silica or alumina supports and a system in which a boron trifluoride catalyst oligomerization is followed by treatment with an organic peroxide.

Mixtures or blends of such 1-alkene oligomers can also be used in the practice of this invention provided the overall blend possesses the requisite viscosity characteristics as specified above. Typical examples of suitable blends of hydrogenated 1-decene oligomers include the following blends in which the typical compositions are expressed in terms of normalized area percentages by GC and wherein "n.d." means "not determined".

75/25 Blend of HITEC 162 and HITEC 164 poly-α-olefin oils:

Composition—Monomer 0.3, Dimer 66.8, Trimer 27.3, Tetramer 4.8, Pentamer 0.8.

Properties—Viscosity at 100° C.: 2.19 cSt; Viscosity at 40° C.: 7.05 cSt; Viscosity at −18° C.: 84.4 cSt; Viscosity at −40° C.: 464 cSt; Pour point: <−65° C.; Flash point (ASTM D 92): 166° C.; NOACK volatility: 78.2%.

50/50 Blend of HITEC 162 and HITEC 164 poly-α-olefin oils:

Composition—Monomer 0.2, Dimer 44.7, Trimer 45.9, Tetramer 7.6, Pentamer 1.3, Hexamer 0.3.

Properties—Viscosity at 100° C.: 2.59 cSt; Viscosity at 40° C.: 9.36 cSt; Viscosity at −18° C.: 133 cSt; Viscosity at −40° C.: 792 cSt; Pour point: <−65° C.; Flash point (ASTM D 92): 168° C.; NOACK volatility: 57.4%.

25/75 Blend of HITEC 162 and HITEC 164 poly-α-olefin oils:

Composition—Monomer 0.1, Dimer 23.1, Trimer 62.7, Tetramer 11.5, Pentamer 2.1, Hexamer 0.5.

Properties—Viscosity at 100° C.: 3.23 cSt; Viscosity at 40° C.: 12.6 cSt; Viscosity at −18° C.: 214 cSt; Viscosity at −40° C.: 1410 cSt; Pour point: <−65°

C.; Flash point (ASTM D 92): 190° C.; NOACK volatility: 30.8%.

95/05 Blend of HITEC 164 and HITEC 166 poly-α-olefin oils:

Composition—Dimer 0.5, Trimer 78.4, Tetramer 15.6, Pentamer 3.7. Hexamer 1.8.

Properties—Viscosity at 100° C.: 4.15 cSt; Viscosity at 40° C.: 17.9 cSt; Viscosity at −18° C.: n.d.; Viscosity at −40° C.: 2760 cSt; Pour point: <−65° C.; Flash point (ASTM D 92): 225° C.; NOACK volatility: 10.5%.

90/10 Blend of HITEC 164 and HITEC 166 poly-α-olefin oils:

Composition—Dimer 0.3, Trimer 76.0, Tetramer 17.0, Pentamer 4.7, Hexamer 2.0.

Properties—Viscosity at 100° C.: 4.23 cSt; Viscosity at 40° C.: 18.4 cSt; Viscosity at −18° C.: n.d.; Viscosity at −40° C.: 2980 cSt; Pour point: <−65° C.; Flash point (ASTM D 92): 228° C.; NOACK volatility: 11.4%.

80/20 Blend of HITEC 164 and HITEC 166 poly-α-olefin oils:

Composition—Dimer 0.3, Trimer 71.5, Tetramer 19.4, Pentamer 6.5, Hexamer 2.3.

Properties—Viscosity at 100° C.: 4.39 cSt; Viscosity at 40° C.: 19.9 cSt; Viscosity at −18° C.: n.d.; Viscosity at −40° C.: 3240 cSt; Pour point: <−65° C.; Flash point (ASTM D 92): 227° C; NOACK volatility: 9.2%.

75/25 Blend of HITEC 164 and HITEC 166 poly-α-olefin oils:

Composition—Dimer 0.7, Trimer 69.0, Tetramer 21.0, Pentamer 7.3, Hexamer 2.0.

Properties—Viscosity at 100° C.: 4.39 cSt; Viscosity at 40° C.: 20.1 cSt; Viscosity at −18° C.: 436 cSt; Viscosity at −40° C.: 3380 cSt; Pour point: <−65° C.; Flash point (ASTM D 92): 226° C.; NOACK volatility: 14.2%.

50/50 Blend of HITEC 164 and HITEC 166 poly-α-olefin oils:

Composition—Dimer 0.4, Trimer 57.3, Tetramer 27.4, Pentamer 11.8, Hexamer 3.1.

Properties—Viscosity at 100° C.: 4.82 cSt; Viscosity at 40° C.: 23.0 cSt; Viscosity at −18° C.: 544 cSt; Viscosity at −40° C.: 4490 cSt; Pour point: <−65° C.; Flash point (ASTM D 92): 226° C.; NOACK volatility: 12.5%.

25/75 Blend of HITEC 164 and HITEC 166 poly-α-olefin oils:

Composition—Dimer 0.3, Trimer 45.3, Tetramer 33.4, Pentamer 16.4, Hexamer 4.6.

Properties—Viscosity at 100° C.: 5.38 cSt; Viscosity at 40° C.: 26.8 cSt; Viscosity at −18° C.: 690 cSt; Viscosity at −40° C.: 6020 cSt; Pour point: <−65° C.; Flash point (ASTM D 92): 250° C.; NOACK volatility: 9.2%.

75/25 Blend of HITEC 166 and HITEC 168 poly-α-olefin oils:

Composition—Dimer 0.4, Trimer 28.4, Tetramer 42.0, 1 Pentamer 22.9, Hexamer 6.3.

Properties—Viscosity at 100° C.: 6.21 cSt; Viscosity at 40° C.: 33.7 cSt; Viscosity at −18° C.: 1070 cSt; Viscosity at −40° C.: 9570 cSt; Pour point: <−65° C.; Flash point (ASTM D 92): 242° C.; NOACK volatility: 6.8%.

50/50 Blend of HITEC 166 and HITEC 168 poly-α-olefin oils:

Composition—Trimer 20.4, Tetramer 45.4, Pentamer 26.5, Hexamer 7.7.

Properties—Viscosity at 100° C.: 6.79 cSt; Viscosity at 40° C.: 38.1 cSt; Viscosity at −18° C.: 1180 cSt; Viscosity at −40° C.: 12200 cSt; Pour point: <−65° C.; Flash point (ASTM D 92): 244° C.; NOACK volatility: 6.0%.

25/75 Blend of HITEC 166 and HITEC 168 poly-α-olefin oils:

Composition—Dimer 0.2, Trimer 13.8, Tetramer 48.0, Pentamer 29.2, Hexamer 8.8.

Properties—Viscosity at 100° C.: 7.27 cSt; Viscosity at 40° C.: 42.2 cSt; Viscosity at −18° C.: 1410 cSt; Viscosity at −40° C.: 15300 cSt; Pour point: −60° C.; Flash point (ASTM D 92): 248° C.; NOACK volatility: 4.3%.

It is also possible in accordance with this invention to utilize blends of one or more liquid hydrogenated 1-alkene oligomers in combination with other oleaginous materials having suitable viscosities, provided that the resultant blend contains a major proportion of hydrogenated poly-α-olefin oligomer fluid having a viscosity in the range of about 2 to about 10 cSt at 100° C. and possesses the requisite compatibility, stability and performance criteria for the use for which the blend is designed, formulated, and provided.

Illustrative non-oligomeric oils and fluids of lubricating viscosity which can be used include synthetic esters such as mixed $C_9$ and $C_{11}$ dialkylphthalates (e.g., ICI Emkarate 911P ester oil), trimethylol propane trioleate, di-(isotridecyl)-adipate (e.g., BASF Glissofluid A13), pentaerythritol tetraheptanoate and the like; and liquid natural fatty oils and esters such as castor oil, olive oil, peanut oil, rapeseed oil, corn oil, sesame oil, cottonseed oil, soybean oil, sunflower oil, safflower oil, hemp oil, linseed oil, tung oil, oiticica oil, jojoba oil, and the like. Such oils may be partially or fully hydrogenated, if desired. The only requirement is that the resultant blend have the requisite properties for the intended use or uses therefor.

It is also possible to include small amounts of mineral oils, commercially available aromatic hydrocarbon mixtures, and/or oleaginous trihydrocarbyl phosphates in blends with one or more linear 1-alkene hydrocarbon oligomers of suitable viscosity, and such blends may in turn contain one or more other base oils (synthetic ester, polyalkylene glycol, natural fatty oil or ester, etc.).

Component A

This component is a hydrogenated poly-α-olefin base oil having a viscosity in the range of about 40 to about 120 cSt at 100° C. Such "PAO" fluids can be synthesized by the same general methods referred to above in connection with the base oils. PAO fluids derived from 1-decene are most preferred. A number of PAO fluids are available as articles of commerce from various suppliers. Typical materials of this type include:

HITEC 174 poly-α-olefin oil:

Properties—Viscosity at 100° C.: 40.0 cSt; Viscosity at 40° C.: 403 cSt; Viscosity at −18° C.: 40200.; Viscosity at −40° C.: Solid; Pour point: −36° C.; Flash point (ASTM D 92): 272° C.; NOACK volatility: 0.8%.

HITEC 180 poly-α-olefin oil:

Properties—Viscosity at 100° C.: 110 cSt; Viscosity at 40° C.: 13.90 cSt; Viscosity at −18° C.: 203000; Viscosity at −40° C.: solid; Pour point: −21° C.;

Flash point (ASTM D 92): 288° C.; NOACK volatility: 0.6%.

These products are available from Ethyl Corporation and/or its affiliates, Ethyl Petroleum Additives, Inc. and Ethyl Petroleum Additives, Ltd. Blends having viscosities between 40 cSt and 110 cSt at 100° C. can be readily formed by blending HiTEC 174 oil and HiTEC 180 oil in appropriate proportions.

Component B

The antiwear/extreme pressure agents used in the practice of this invention are ashless dispersants which contain phosphorus or boron or phosphorus and boron. The ashless dispersant can be of various types including succinimides, succinamides, succinic esters, succinic ester-amides, Mannich products, long chain hydrocarbyl amines, polyol esters, or the like. Of these, the succinimides are preferred for use in the practice of this invention.

Methods for the production of the foregoing types of ashless dispersants are well known to those skilled in the art and are extensively reported in the patent literature. Likewise methods for introducing phosphorus or boron or a combination of phosphorus and boron into such ashless dispersants are likewise known to those skilled in the art and reported in the patent literature. For example, the synthesis of various ashless dispersants of the foregoing types is described in such patents as U.S. Pat. Nos. 2,459,112; 2,962,442; 2,984,550; 3,036,003; 3,163,603; 3,166,516; 3,172,892; 3,184,474; 3,202,678; 3,215,707; 3,216,936; 3,219,666; 3,236,770; 3,254,025; 3,271,310; 3,272,746; 3,275,554; 3,281,357; 3,306,908; 3,311,558; 3,316,177; 3,331,776; 3,340,281; 3,341,542; 3,346,493; 3,351,552; 3,355,270; 3,368,972; 3,381,022; 3,399,141; 3,413,347; 3,415,750; 3,433,744; 3,438,757; 3,442,808; 3,444,170; 3,448,047; 3,448,048; 3,448,049; 3,451,933; 3,454,497; 3,454,555; 3,454,607; 3,459,661; 3,461,172; 3,467,668; 3,493,520; 3,501,405; 3,522,179; 3,539,633; 3,541,012; 3,542,680; 3,543,678; 3,558,743; 3,565,804; 3,567,637; 3,574,101; 3,576,743; 3,586,629; 3,591,598; 3,600,372; 3,630,904; 3,632,510; 3,632,511; 3,634,515; 3,649,229; 3,697,428; 3,697,574; 3,703,536; 3,704,308; 3,725,277; 3,725,441; 3,725,480; 3,726,882; 3,736,357; 3,751,365; 3,756,953; 3,793,202; 3,798,165; 3,798,247; 3,803,039; 3,804,763; 3,836,471; 3,862,981; 3,936,480; 3,948,800; 3,950,341; 3,957,854; 3,957,855; 3,980,569; 3,991,098; 4,071,548; 4,173,540; 4,234,435; and Re 26,433. The disclosures of the foregoing patents are incorporated by reference with respect to ashless dispersants and methods for their preparation.

The preferred ashless dispersants for use in forming phosphorus- or boron-containing ashless dispersants or ashless dispersants containing both phosphorus and boron are one or more alkenyl succinimides of an amine having at least one primary amino group capable of forming an imide group. The alkenyl succinimides may be formed by conventional methods such as by heating an alkenyl succinic anhydride, acid, acid-ester, acid halide, or lower alkyl ester with an amine containing at least one primary amino group. The alkenyl succinic anhydride may be made readily by heating a mixture of olefin and maleic anhydride to about 180°-220° C. The olefin is preferably a polymer or copolymer of a lower monoolefin such as ethylene, propylene, isobutene and the like. The more preferred source of alkenyl group is from polyisobutene having a molecular weight up to 10,000 or higher. In a still more preferred embodiment the alkenyl group is a polyisobutene group having a number average molecular weight of about 500-5,000, and preferably about 900-2,000, especially 900-1,300.

Amines which may be employed in forming the ashless dispersant include any that have at least one primary amino group which can react to form an imide group and at least one additional primary or secondary amino group and/or at least one hydroxyl group. A few representative examples are: N-methyl-propanediamine, N-dodecyl-propanediamine, N-aminopropyl-piperazine, ethanolamine, N-ethanol-ethylenediamine and the like.

Preferred amines are the alkylene polyamines such as propylene diamine, dipropylene triamine, di-(1,2-butylene)triamine, and tetra-(1,2-propylene)pentamine.

The most preferred amines are the ethylene polyamines which can be depicted by the formula $$H_2N(CH_2CH_2NH)_nH$$

wherein n is an integer from one to about ten. These include: ethylene diamine, diethylene triamine, triethylene tetramine, tetraethylene pentamine, pentaethylene hexamine, and the like, including mixtures thereof in which case n is the average value of the mixture. These ethylene polyamines have a primary amine group at each end so can form mono-alkenylsuccinimides and bisalkenylsuccinimides. Commercially available ethylene polyamine mixtures usually contain minor amounts of branched species and cyclic species such as N-aminoethyl piperazine, N,N'-bis(aminoethyl)piperazine, N,N'-bis(piperazinyl)ethane, and like compounds. The preferred commercial mixtures have approximate overall compositions falling in the range corresponding to diethylene triamine to tetraethylene pentamine, mixtures generally corresponding in overall makeup to tetraethylene pentamine being most preferred.

Thus especially preferred ashless dispersants for use in the present invention are the products of reaction of a polyethylene polyamine, e.g. triethylene tetramine or tetraethylene pentamine, with a hydrocarbon substituted carboxylic acid or anhydride made by reaction of a polyolefin, preferably polyisobutene, having a number average molecular weight of 500 to 5,000, preferably 900 to 2,000 and especially 900 to 1,300, with an unsaturated polycarboxylic acid or anhydride, e.g., maleic anhydride, maleic acid, fumaric acid, or the like, including mixtures of two or more such substances.

Methods suitable for introducing phosphorus or boron or a combination of phosphorus and boron into ashless dispersants are likewise known and reported in the patent literature. See for example such patents as U.S. Pat. Nos. 3,087,936; 3,184,411; 3,185,645; 3,235,497; 3,254,025; 3,265,618; 3,281,428; 3,282,955; 3,284,410; 3,324,032; 3,338,832; 3,344,069; 3,403,102; 3,428,561; 3,502,677; 3,511,780; 3,513,093; 3,533,945; 3,623,985; 3,718,663; 3,865,740; 3,945,933; 3,950,341; 3,991,056; 4,093,614; 4,097,389; 4,428,849; 4,338,205; 4,428,849; 4,554,086; 4,615,826; 4,634,543; 4,648,980; 4,747,971, and 4,857,214. The disclosures of each of the foregoing patents are incorporated herein by reference with respect to phosphorus- and/or boron-containing ashless dispersants and their production. The procedures described in U.S. Pat. No. 4,857,214 are especially preferred for use in forming component B of the compositions of this invention.

Accordingly, one preferred group of phosphorus- and/or boron-containing ashless dispersants comprises aliphatic hydrocarbyl-substituted succinimide of a mixture of cyclic and acyclic polyethylene polyamines having an approximate average overall composition falling in the range of from diethylene triamine through pentaethylene hexamine, said succinimide being heated with (1) at least one phosphorylating agent to form a phosphorus-containing succinimide ashless dispersant; or (2) at least one boronating agent to form a boron-containing succinimide ashless dispersant; or (3) either concurrently or in any sequence with at least one phosphorylating agent and at least one boronating agent to form a phosphorus- and boron-containing succinimide ashless dispersant. Particularly preferred ashless dispersants for use as component B are aliphatic hydrocarbyl-substituted succinimides of the type just described which have been heated concurrently or in any sequence with a boron compound such as a boron acid, boron ester, boron oxide, or the like (preferably boric acid) and an inorganic phosphorus acid or anhydride (preferably phosphorous acid, $H_3PO_3$) or a partial or total sulfur analog thereof to form an oil-soluble product containing both boron and phosphorus.

Combinations of boronated succinimides and phosphorus-containing esters, especially combinations of this type which have been subjected to temperatures of at least about 40° C. during blending or formulation operations, are also suitable for use in the practice of this invention. Typical phosphorus-containing esters which may be used in such combinations include trihydrocarbyl phosphates, trihydrocarbyl phosphites, dihydrocarbyl phosphates, dihydrocarbyl phosphonates or dihydrocarbyl phosphites or mixtures thereof, monohydrocarbyl phosphates, mono-hydrocarbyl phosphites, sulfur-containing analogs of any of the foregoing compounds, and mixtures of any two or more of the foregoing. Dihydrocarbyl and trihydrocarbyl sulfur-containing analogs can be formed in situ by reaction between active sulfur-containing components and dihydrocarbyl phosphites, trihydrocarbyl phosphites, sulfur analogs of such phosphites, or mixtures of any two or more of such phosphites or di- and trithiophosphites. As is well known, O-hydrocarbyl, O,O-dihydrocarbyl, S-hydrocarbyl, S,S-dihydrocarbyl, and/or O,S-dihydrocarbyl esteracids can be formed in situ by hydrolyzing O,O,O-trihydrocarbyl, O,O,S-trihydrocarbyl, O,S,S-trihydrocarbyl, and/or S,S,S-trihydrocarbyl phosphates or thiophosphates. Such hydrolytic reactions may be depicted as follows:

$$(RX)_3P(X)_b \xrightarrow{H_2O} (HO)_c(RX)_dP(X)_b$$

where each X is, independently, an oxygen atom or a sulfur b is 0 or 1, and c and d are numbers such that c is less than 3 and the sum of c and d is 3. In the case of mixtures, b or c and d or b, c, and d represent average values, and can be fractional numbers whereby b can be 0 or 1 or any fractional number between 0 and 1 (e.g. as when hydrolyzing a mixture of trihydrocarbyl phosphite and trihydrocarbyl phosphate) and c and d can be fractional or whole numbers totaling 3. Similarly, in situ hydrolysis of O,O-dihydrocarbyl, O,S-dihydrocarbyl, and/or S,S-dihydrocarbyl ester-acids results in formation of O-hydrocarbyl, and/or S-hydrocarbyl ester-acids. Any such phosphorus acid-ester can be present in the form of a salt or adduct with one or more amines —including the amine moieties in basic nitrogen-containing succinimides, or basic nitrogen-containing boronated succinimides —and/or other substituted basic nitrogen-containing compounds if present in the system, such as alkanol amines, ether amines, triazines, and the like.

Thus, in one of its embodiments, this invention provides compositions which contain a phosphorus-containing succinimide, a boron-containing succinimide, and/or a phosphorus- and boron-containing succinimide, together with at least one phosphorus-containing substance selected from (1) one or more inorganic acids of phosphorus; or (2) one or more inorganic thioacids of phosphorus; or (3) one or more monohydrocarbyl esters of one or more inorganic acids of phosphorus; or (4) one or more monohydrocarbyl esters of one or more inorganic thioacids of phosphorus; or (5) any combination of any two, or any three or all four of (1), (2), (3), and (4); or at least one oil-soluble amine salt or complex or adduct of any of (1), (2), (3), (4), and (5), said amine optionally being in whole or in part an amine moiety in (i) a basic nitrogen-containing succinimide or (ii) a boron- and basic nitrogen-containing succinimide or (iii) a phosphorus- and basic nitrogen-containing succinimide or (iv) a phosphorus-, boron- and basic nitrogen-containing succinimide.

Other Components

In accordance with conventional practice, various other known components can be employed in the foregoing compositions in order to partake of the properties engendered by use of such known additives. It is contemplated that any known additive can be included so long as (a) it is compatible with and soluble in the finished oleaginous liquid composition, (b) it does not contribute to the presence of more than 100 ppm of metal in the finished oleaginous liquid composition, and (c) it does not cause the finished oleaginous liquid composition to have viscosity characteristics other than (i) a kinematic viscosity of at least 5.5 cSt at 100° C. and a Brookfield viscosity of less than 20,000 cP at −40° C.; or (ii) a kinematic viscosity of at least 6.8 cSt at 100° C. and a Brookfield viscosity of less than 50,000 cP at −40° C.

Described below are illustrative examples of the types of conventional additives that may be employed in the compositions of this invention.

In accordance with known practice, additives may be introduced into the compositions of this invention in order to improve the seal performance (elastomer compatibility) of the compositions. Known materials of this type include dialkyl diesters such as dioctyl sebacate, aromatic hydrocarbons of suitable viscosity such as Panasol AN-3N, products such as Lubrizol 730, polyol esters such as Emery 2935, 2936, and 2939 esters from the Emery Group of Henkel Corporation and Hatcol 2352, 2962, 2925, 2938, 2939, 2970, 3178, and 4322 polyol esters from Hatco Corporation. Generally speaking the most suitable diesters include the adipates, azelates, and sebacates of $C_8$–$C_{13}$ alkanols (or mixtures thereof), and the phthalates of $C_4$–$C_{13}$ alkanols (or mixtures thereof). Mixtures of two or more different types of diesters (e.g., dialkyl adipates and dialkyl azelates, etc.) can also be used. Examples of such materials include the n-octyl, 2-ethylhexyl, isodecyl, and tridecyl diesters of adipic acid, azelaic acid, and sebacic acid, and the n-butyl, isobutyl, pentyl, hexyl, heptyl, octyl, nonyl, decyl, undecyl, dodecyl, and tridecyl diesters of phthalic acid.

The additive compositions and oleaginous liquid compositions of this invention can also contain antioxidant, e.g., one or more phenolic antioxidants, aromatic amine antioxidants, sulphurised phenolic antioxidants, and organic phosphites, among others. Examples include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, 4,4'-thiobis(2-methyl-6-tert-butylphenol), N,N'-di-sec-butyl-p-phenylenediamine, 4-isopropylaminodiphenyl amine, phenyl-α-naphthyl amine, and phenyl-β-naphthyl amine.

Corrosion inhibitors comprise another type of optional additive for use in this invention. Thus use can be made of dimer and trimer acids, such as are produced from tall oil fatty acids, oleic acid, linoleic acid, or the like. Products of this type are currently available from various commercial sources, such as, for example, the dimer and trimer acids sold under the HYSTRENE trademark by the Humco Chemical Division of Witco Chemical Corporation and under the EMPOL trademark by Emery Chemicals. Another useful type of corrosion inhibitor for use in the practice of this invention are the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having 8 to 24 carbon atoms in the alkenyl group with alcohols such as the polyglycols. Other suitable corrosion inhibitors include ether amines; acid phosphates; amines; polyethoxylated compounds such as ethoxylated amines, ethoxylated phenols, and ethoxylated alcohols; imidazolines; aminosuccinic acids or derivatives thereof, and the like. Materials of these types are well known to those skilled in the art and a number of such materials are available as articles of commerce.

Foam inhibitors are likewise suitable for use as optional components in the compositions of this invention. These include silicones, polyacrylates, surfactants, and the like.

Copper corrosion inhibitors constitute another class of additives suitable for inclusion in the compositions of this invention. Such compounds include thiazoles, triazoles and thiadiazoles. Examples of such compounds include benzotriazole, tolyltriazole, octyltriazole, decyltriazole, dodecyltriazole, 2-mercapto benzothiazole, 2,5-dimercapto-1,3,4-thiadiazole, 2-mercapto-5-hydrocarbylthio-1,3,4-thiadiazoles, 2-mercapto-5-hydrocarbyldithio-1,3,4-thiadiazoles, 2,5-bis(hydrocarbylthio) -1,3,4-thiadiazoles, and 2,5-(bis)hydrocarbyldithio)-1,3,4-thiadiazoles. The preferred compounds are the 1,3,4-thiadiazoles, a number of which are available as articles of commerce. Such compounds are generally synthesized from hydrazine and carbon disulfide by known procedures. See for example U.S. Pat. Nos. 2,765,289; 2,749,311; 2,760,933; 2,850,453; 2,910,439; 3,663,561; 3,862,798; and 3,840,549.

The compositions of this invention may also contain friction modifiers such as aliphatic amines or ethoxylated aliphatic amines, aliphatic fatty acid amides, aliphatic carboxylic acids, aliphatic carboxylic esters, aliphatic carboxylic esteramides, aliphatic phosphonates, aliphatic phosphates, aliphatic thiophosphonates, aliphatic thiophosphates, etc., wherein the aliphatic group usually contains above about eight carbon atoms so as to render the compound suitably oil soluble. Also suitable are aliphatic substituted succinimides formed by reacting one or more aliphatic succinic acids or anhydrides with ammonia.

Metal-containing detergents such as calcium phenates, magnesium phenates, calcium sulfonates, magnesium sulfonates, etc. can also be used. However, as noted above, if an oil-soluble phenate or sulfonate is used it should be proportioned such that the finished fluid contains no more than about 100 ppm of metal.

Still other components useful in the compositions of this invention are lubricity agents such as sulfurized fats, sulfurized isobutylene, dialkyl polysulfides, and sulfur-bridged phenols such as nonylphenol polysulfide. Dyes, pour point depressants, viscosity index improvers, air release agents, and the like can also be included in the compositions of this invention.

In selecting any of the foregoing optional additives, it is of course important to ensure that the selected component(s) are soluble in the oleaginous liquid, are compatible with the other components of the composition, and do not interfere significantly with the viscosity and/or shear stability properties desired in the overall finished oleaginous composition.

Concentrations and Proportions

In general, the components of the additive compositions of this invention are employed in the oleaginous liquids in minor amounts sufficient to improve the performance characteristics and properties of the base fluid. The amounts will thus vary in accordance with such factors as the viscosity characteristics of the base fluid employed, the viscosity characteristics desired in the finished fluid, the service conditions for which the finished fluid is intended, and the performance characteristics desired in the finished fluid. However, generally speaking, the following concentrations (weight percent) of the components (active ingredients) in the base fluids are illustrative:

| | General Range | Preferred Range | More Preferred Range | Particularly Preferred Range |
|---|---|---|---|---|
| Component (A) | 1-30 | 1-15 | 1-10 | 5-10 |
| Component (B) | 1-15 | 1-10 | 1-6 | 2-5 |

The concentrations (weight percent) of typical optional ingredients in the oleaginous liquid compositions of this invention are generally as follows:

| | Typical Range | Preferred Range |
|---|---|---|
| Seal performance improver | 0-30 | 2-20 |
| Antioxidant | 0-1 | 0.25-1 |
| Corrosion inhibitor | 0-0.5 | 0.01-0.1 |
| Foam inhibitor | 0-0.01 | 0.0001-0.005 |
| Copper corrosion inhibitor | 0-0.5 | 0.01-0.05 |
| Friction modifier | 0-1 | 0.05-0.5 |
| Lubricity agent | 0-1.5 | 0.5-1 |
| Viscosity index improver | 0-10 | 0-4 |
| Dye | 0-0.05 | 0.015-0.035 |

It will be appreciated that the individual components A and B, and also any and all auxiliary components employed, can be separately blended into the base fluid or can be blended therein in various subcombinations, if desired. Ordinarily, the particular sequence of such blending steps is not critical. Moreover, such components can be blended in the form of separate solutions in a diluent. It is preferable, however, to blend the components used in the form of an additive concentrate of this invention, as this simplifies the blending operations, reduces the likelihood of blending errors, and takes advantage of the compatibility and solubility characteristics afforded by the overall concentrate.

The additive concentrates of this invention will contain components A and B) in amounts proportioned to yield finished fluid blend consistent with the concentrations tabulated above. In most cases, the additive concentrate will contain one or more diluents such as light mineral oils, to facilitate handling and blending of the concentrate. Thus concentrates containing up to 50% by weight of one or more diluents or solvents can be used.

The oleaginous liquids provided by this invention can be used in a variety of applications. For example, they can be employed as crankcase lubricants, gear oils, hydraulic fluids, manual transmission fluids, cutting and machining fluids, brake fluids, shock absorber fluids, heat transfer fluids, quenching oils, transformer oils, and the like. The compositions are particularly suitable for use as automatic transmission fluids.

The practice and advantages of this invention are illustrated by the following illustrative examples in which all percentages are by weight unless otherwise specified.

EXAMPLE 1

An automatic transmission fluid is formed by blending together the following components:

40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180 fluid);
20.00% Diisononyl adipate;
5.58% ATF additive concentrate;
0.02% Dye.

The ATF additive concentrate is composed of the following components:

67.56% Phosphorus- and boron-containing ashless dispersant[1];
2.69% Ethoxylated amines[2];
0.72% Tolyltriazole (Cobratec TT-100);
1.06% Silicone antifoam agent (4% solution in hydrocarbon);
4.66% Bis-(p-nonylphenyl)amine (Naugalube 438L);
0.90% Calcium phenate[3];
0.90% Octanoic acid;
8.60% Sulfurized fat[4]
12.91% Mineral oil diluent.

1 Prepared as in Example 1A of U.S. Pat. No. 4,857,214, and this component contains approximately 25% mineral oil diluent.
2 A combination of 2.24% Ethomeen T-12 (Akzo Chemical, Inc.) and 0.45% Tomah PA-14 (Exxon Chemical Company).
3 OLOA 216C (Chevron Chemical Company). 4. Sulperm 10S (Keil Products Division of Ferro Corporation).

EXAMPLE 2

An automatic transmission fluid is formed by blending together the following components:

40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180fluid);
20.00% Diisononyl adipate;
5.58% ATF additive concentrate;
0.02% Dye.

The ATF additive concentrate is composed of the following components:

67.56% Phosphorus- and boron-containing ashless dispersant[1];
2.95% Ethoxylated amine[2];
0.72% 2,5-dimethylthio-1,3,4-thiadiazole;
1.06% Silicone antifoam agent (4% solution in hydrocarbon);
4.66% Bis-(p-nonylphenyl)amine (Naugalube 438L);
1.80% Surfactant[3];
0.90% Calcium phenate[4];
0.90% Octanoic acid;
19.45% Mineral oil diluent.

1 Prepared as in Example 1A of U.S. Pat. No. 4,857,214, and this component contains approximately 25% mineral oil diluent.
2 Ethomeen T-12.
3 Pluronic L-81.
4 OLOA 225.

EXAMPLE 3

An automatic transmission fluid is formed by blending together the following components:

40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180 fluid);
20.00% Diisononyl adipate;
5.58% ATF additive concentrate;
0.02% Dye.

The ATF additive concentrate is composed of the following components:

67.56% Phosphorus- and boron-containing ashless dispersant[1];
2.69% Ethoxylated amine[2];
0.72% Benzotriazole (Cobratec 99);
1.06% Silicone antifoam agent (4% solution in hydrocarbon);
4.66% Bis-(p-nonylphenyl)amine (Naugalube 438L);
1.62% Surfactants[3];
1.05% Octanoic acid;
4.45% Sulfurized fat[4];
16.19% Mineral oil diluent.

1 Prepared as in Example 1A of U.S. Pat. No. 4,857,214, and this component contains approximately 25% mineral oil diluent.
2 Tomah PA-14.
3 A combination of 1.14% PC 1244 and 0.48% Pluronic L-81.
4. Sulperm 10S.

EXAMPLE 4

An automatic transmission fluid is formed by blending together the following components:

40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180 fluid);
20.00% Diisononyl adipate;
5.58% ATF additive concentrate;
0.02% Dye.

The ATF additive concentrate is composed of the following components:

67.56% Phosphorus- and boron-containing ashless dispersant[1];
3.44% Ethoxylated amines[2];
0.72% 2,5-dimethylthio-1,3,4-thiadiazole;
1.06% Silicone antifoam agent (4% solution in hydrocarbon);
4.66% Ethyl ®antioxidant 728 (Ethyl Corporation);
1.48% Surfactant[3];
0.90% Calcium phenate[4];
0.90% Octanoic acid;
2.75% Sulfurized isobutylene;
16.53% Mineral oil diluent.

1 Prepared as in Example 1A of U.S. Pat. No. 4,857,214, and this component contains approximately 25% mineral oil diluent.
2 A combination of 1.88% Ethomeen T-12 and 1.56% Tomah PA-14.
3 Mazawet 77.

4 OLOA 218A.

EXAMPLE 5

An automatic transmission fluid is formed by blending together the following components:
40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180 fluid);
20.00% Diisononyl adipate;
5.58% ATF additive concentrate;
0.02% Dye.

The ATF additive concentrate is composed of the following components:
67.56% Phosphorus- and boron-containing ashless dispersant[1];
2.69% Ethoxylated amines[2];
0.72% 2,5-dimethylthio-1,3,4-thiadiazole;
1.06% Silicone antifoam agent (4% solution in hydrocarbon);
4.66% Bis-(p-nonylphenyl)amine (Naugalube 43BL);
1.62% Surfactants[3];
0.90% Calcium phenate[4];
0.90% Octanoic acid;
8.60% Sulfurized fat[5];
11.29% Mineral oil diluent.

1 Prepared as in Example 1A of U.S. Pat. No. 4,857,214, and this component contains approximately 25% mineral oil diluent.
2 A combination of 1.79% Ethomeen T-12 and 0.90% Tomah PA-1.
3 A combination of 0.54% PC 1244, 0.90% Mazawet 77, and 0.18% Pluronic L-81.
4 OLOA 216C.
5. Sulperm 10S.

EXAMPLE 6

An automatic transmission fluid is formed by blending together the following components:
40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180 fluid);
20.00% Diisononyl adipate;
5.58% ATF additive concentrate;
0.02% Dye.

The ATF additive concentrate is composed of the following components:
67.56% Phosphorus- and boron-containing ashless dispersant[1];
2.95% Ethoxylated amines[2];
0.72% 2,5-dimethylthio-1,3,4-thiadiazole;
1.06% Silicone antifoam agent (4% solution in hydrocarbon);
4.66% Bis-(p-nonylphenyl)amine (Naugalube 438L);
1.85% Surfactant[3];
0.90% Calcium phenate[4];
0.90% Octanoic acid;
7.42% Sulfurized fat[5];
11.98% Mineral oil diluent.

1 Prepared as in Example 1A of U.S. Pat. No. 4,857,214, and this component contains approximately 25% mineral oil diluent.
2 A combination of 1.79% Ethomeen T-12 and 0.90% Tomah PA-14.
3 PC 1244.
4 OLOA 218A.
5. Sulperm 60-93 (Keil Products Division of Ferro Corporation).

EXAMPLE 7

An automatic transmission fluid is formed by blending together the following components:
40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180 fluid);
20.00% Diisononyl adipate;
5.58% ATF additive concentrate;
0.02% Dye.

The ATF additive concentrate is composed of the following components:
67.56% Phosphorus- and boron-containing ashless dispersant[1];
2.35% Ethoxylated amines[2];
0.70% Tolyltriazole;
1.06% Silicone antifoam agent (4% solution in hydrocarbon);
8.65% Ethyl ®antioxidant 728 OM50 (Ethyl Corporation);
1.58% Surfactants[3];
0.90% Calcium phenate[4];
0.90% Octanoic acid;
4.42% Sulfurized fat[5];
11.88% Mineral oil diluent. 1 Prepared as in Example 1A of U.S. Pat. No. 4,857,214, and this component contains approximately 25% mineral oil diluent. 2 A combination of 1.40% Ethomeen T-12 and 0.95% Tomah PA-14. 3 A combination of 0.95% PC 1244 and 0.63% Mazawet 77. 4 OLOA 216C. 5. Sulperm 60-93.

EXAMPLE 8

Examples 1–7 are repeated using the following components:
38.92% 6 cSt poly-α-olefin fluid (HiTEC® 166 fluid);
27.74% 8 cSt poly-α-olefin fluid (HiTEC® 168 fluid);
5.74% 110 cSt poly-α-olefin fluid (HiTEC® 180 fluid);
20.00% Di(tridecyl) adipate;
2.00% Aromatic hydrocarbon (Panasol AN-3N);
5.58% ATF additive concentrates of Examples 1–7, respectively;
0.02% Dye.

EXAMPLE 9

Example 8 is repeated substituting in each case dibutyl phthalate for the aromatic hydrocarbon (Panasol AN-3N).

EXAMPLE 10

Examples 1–7 are repeated using the following components:
45.38% 6 cSt poly-α-olefin fluid (HiTEC® 166 fluid);
32.33% 8 cSt poly-α-olefin fluid (HiTEC® 168 fluid);
6.69% 110 cSt poly-α-olefin fluid (HiTEC® 180 fluid);
10.00% Synthetic ester (Hatcol 2923; Hatco Corporation);
5.58% ATF additive concentrates of Examples 1–7, respectively;
0.02% Dye.

EXAMPLE 11

Examples 1–7 are repeated using the following components:
40.00% 6 cSt poly-α-olefin fluid (HiTEC® 166 fluid);
28.50% 8 cSt poly-α-olefin fluid (HiTEC® 168 fluid);
5.90% 110 cSt poly-α-olefin fluid (HiTEC® 180 fluid);
20.00% Synthetic ester (Hatcol 2920);
5.58% ATF additive concentrates of Example 1–7, respectively;
0.02% Dye.

EXAMPLE 12

Examples 1–7 are repeated using the following components:
45.38% 6 cSt poly-α-olefin fluid (HiTEC® 166 fluid);
32.33% 8 cSt poly-α-olefin fluid (HiTEC® 168 fluid);
6.69% 110 cSt poly-α-olefin fluid (HiTEC® 180 fluid);

10.00% Synthetic ester (Hatcol 2920);
5.58% ATF additive concentrates of Examples 1–7, respectively;
0.02% Dye.

EXAMPLE 13

The procedure of Example 12 is repeated substituting Hatcol 2915 for the Hatcol 2920.

EXAMPLE 14

The procedure of Example 12 is repeated substituting Hatcol 2970 for the Hatcol 2920.

EXAMPLE 15

The procedure of Example 8 is repeated except that dioctyl sebacate is used in lieu of the di(tridecyl) adipate.

EXAMPLE 16

The procedure of Example 15 is repeated except that dibutyl phthalate is used in place of the aromatic hydrocarbon (Panasol AN-3N).

EXAMPLE 17

The procedure of Example 16 is repeated except that tricresyl phosphate is used in place of the dibutyl phthalate.

EXAMPLE 18

The procedure of Example 15 is repeated except that the dioctyl sebacate is replaced by di(tridecyl) phthalate.

EXAMPLE 19

The procedure of Example 18 is repeated except that the dibutyl phthalate replaces the aromatic hydrocarbons (Panasol AN-3N).

EXAMPLE 20

The procedure of Example 19 is repeated except that tricresyl phosphate replaces the dibutyl phthalate.

EXAMPLE 21

The procedure of Example 20 is repeated except that Vistone A-30 replaces the di(tridecyl) phthalate.

EXAMPLE 22

The procedure of Example 21 is repeated except that Lubrizol 730 additive replaces the tricresyl phosphate.

EXAMPLE 23

The procedures of Examples 1–7 are repeated using the following components:
65.42% 6 cSt poly-α-olefin fluid (HiTEC® 166 fluid);
4.00% 110 cSt poly-α-olefin fluid (HiTEC® 180 fluid);
25.00% Polyol ester (Emery 2935; Emery Group of Henkel Corporation);
5.58% ATF additive concentrates of Examples 1–7, respectively.

EXAMPLE 24

The procedure of Example 23 is repeated except that the polyol ester is Emery 2939.

EXAMPLE 25

The procedures of Examples 1–7 ar repeated using the following components:
84.42% 6 cSt poly-α-olefin fluid (HiTEC® 166 fluid);
4.00% 110 cSt poly-α-olefin fluid (HiTEC® 180 fluid);
6.00% Dibutyl phthalate;
5.58% ATF additive concentrates of Examples 1–7, respectively.

EXAMPLE 26

The procedures of Examples 1–7 are repeated using the following components:
83.12% 6 cSt poly-α-olefin fluid (HiTEC® 166 fluid);
5.90% 110 cSt poly-α-olefin fluid (HiTEC® 180 fluid);
5.40% Dibutyl phthalate;
5.58% ATF additive concentrates of Examples 1–7, respectively.

EXAMPLE 27

The procedures of Examples 1–7 are repeated using the following components:
64.42% 6 cSt poly-α-olefin fluid (HiTEC® 166 fluid);
10.00% 8 cSt poly-α-olefin fluid (HiTEC® 168 fluid);
6.00% 110 cSt poly-α-olefin fluid (HiTEC® 180 fluid);
14.00% Polyol ester (Hatcol 2915);
5.58% ATF additive concentrates of Examples 1–7, respectively.

EXAMPLE 28

The procedures of Examples 1 through 27 are repeated except that the phosphorus- and boron-containing ashless dispersant used in the ATF additive concentrates is prepared as in Example 2 of U.S. Pat. No. 4,857,214.

EXAMPLE 29

The procedures of Examples 1 through 27 are repeated except that the phosphorus- and boron-containing ashless dispersant used in the ATF additive concentrates is prepared as in Example 3 of U.S. Pat. No. 4,857,214.

EXAMPLE 30

The procedures of Examples 1 through 27 are repeated except that the phosphorus- and boron-containing ashless dispersant used in the ATF additive concentrates is replaced by a phosphorus-containing ashless dispersant prepared as in Example 5 of U.S. Pat. No. 4,857,214.

EXAMPLE 31

The procedures of Examples 1 through 27 are repeated except that the phosphorus- and boron-containing ashless dispersant used in the ATF additive concentrates is replaced by a phosphorus-containing ashless dispersant prepared as in Example 6 of U.S. Pat. No. 4,857,214.

EXAMPLE 32

The procedures of Examples 1 through 27 are repeated except that the phosphorus- and boron-containing ashless dispersant used in the ATF additive concentrates is replaced by a phosphorus-containing ashless dispersant prepared as in Example 7 of U.S. Pat. No. 4,857,214.

EXAMPLE 33

The procedures of Examples 1 through 27 are repeated except that the phosphorus- and boron-containing ashless dispersant used in the ATF additive concentrates is replaced by a phosphorus-containing ashless dispersant prepared as in Example 8 of U.S. Pat. No. 4,857,214.

EXAMPLE 34

The procedures of Examples 1 through 27 are repeated except that the phosphorus- and boron-containing ashless dispersant used in the ATF additive concentrates is replaced by a phosphorus-containing ashless dispersant prepared as in Example 9 of U.S. Pat. No. 4,857,214.

EXAMPLE 35

The procedures of Examples 1 through 27 are repeated except that the phosphorus- and boron-containing ashless dispersant used in the ATF additive concentrates is replaced by a phosphorus-containing ashless dispersant prepared as in Example 10 of U.S. Pat. No. 4,857,214.

EXAMPLE 36

The procedures of Examples 1 through 27 are repeated except that the phosphorus- and boron-containing ashless dispersant used in the ATF additive concentrates is replaced by a commercially available boron-containing ashless dispersant (HiTEC® 648 additive; Ethyl Petroleum Additives, Inc.; Ethyl Petroleum Additives, Ltd.).

EXAMPLE 37

The procedures of Examples 1 through 27 are repeated except that the ATF additive concentrate used is a commercially available ATF additive package (Paranox 445 additive; Exxon Chemical Company).

EXAMPLE 38

The procedures of Examples 8 through 36 are repeated except that the ATF additive concentrate used is the additive concentrate of Example 1 modified so that it contains 6.68% of a 50% solution of methylene-bridged alkyl phenols in mineral oil (ETHYL® antioxidant 728 OM50; Ethyl Corporation), and so that the amount of mineral oil diluent is reduced from 12.91% to 10.89%.

EXAMPLE 39

The procedures of Examples 8 through 36 are repeated except that the ATF additive concentrate used is the additive concentrate of Example 2 modified so that it contains 7.05% of a 60% solution of mixed tertiary butylphenols in mineral oil, and so that the amount of mineral oil diluent is reduced from 19.45% to 17.06%.

EXAMPLE 40

The procedures of Examples 8 through 36 are repeated except that the ATF additive concentrate used is the additive concentrate of Example 3 modified so that it contains 7.36% of a 50% solution of methylene-bridged alkyl phenols in mineral oil (ETHYL® antioxidant 728 OM50; Ethyl Corporation), and so that the amount of mineral oil diluent is reduced from 16.19% to 13.49%.

EXAMPLE 41

The procedures of Examples 8 through 36 are repeated except that the ATF additive concentrate used is the additive concentrate of Example 5 modified so that it contains 7.17% of a 50% solution of methylene-bridged alkyl phenols in mineral oil (ETHYL® antioxidant 728 OM50; Ethyl Corporation), and so that the amount of mineral oil diluent is reduced from 11.29% to 4.12%.

EXAMPLE 42

The procedures of Examples 8 through 36 are repeated except that the ATF additive concentrate used is the additive concentrate of Example 6 modified so that it contains 6.95% of a 50% solution of 4,4'-methylene-bis(2,6-di-tert-butylphenol) in mineral oil, and so that the amount of mineral oil diluent is reduced from 11.98% to 9.69%.

EXAMPLE 43

The ATF additive concentrate of Example 38 is blended at a concentration of 5.58% in an automatic transmission fluid formulation composed of 16.05% HiTEC 164 fluid; 64.25% HiTEC 166 fluid; 8.70% HiTEC 180 fluid; 5.40% dibutyl phthalate; and 0.02% dye.

EXAMPLE 44

The ATF additive concentrate of Example 39 is blended at a concentration of 5.58% in an automatic transmission fluid formulation composed of 16.05% HiTEC 164 fluid; 64.25% HiTEC 166 fluid; 8.70% HiTEC 180 fluid; 5.40% dibutyl phthalate: and 0.02% dye.

EXAMPLE 45

The ATF additive concentrate of Example 40 is blended at a concentration of 5.58% in an automatic transmission fluid formulation composed of 16.05% HiTEC 164 fluid; 64.25% HiTEC 166 fluid; 8.70% HiTEC 180 fluid; 5.40% dibutyl phthalate; and 0.02% dye.

EXAMPLE 46

The ATF additive concentrate of Example 41 is blended at a concentration of 5.58% in an automatic transmission fluid formulation composed of 16.05% HiTEC 164 fluid; 64.25% HiTEC 166 fluid; 8.70% HiTEC 180 fluid; 5.40% dibutyl phthalate; and 0.02% dye.

EXAMPLE 47

The ATF additive concentrate of Example 42 is blended at a concentration of 5.58% in an automatic transmission fluid formulation composed of 16.05% HiTEC 164 fluid; 64.25% HiTEC 166 fluid; 8.70% HiTEC 180 fluid; 5.40% dibutyl phthalate; and 0.02% dye.

All experimental results obtained to date indicate that the compositions of the foregoing examples possess either (i) a kinematic viscosity of at least 5.5 cSt at 100° C. and a Brookfield viscosity of less than 20,000 cP at −40° C.; or (ii) a kinematic viscosity of at least 6.8 cSt at 100° C. and a Brookfield viscosity of less than 50,000 cP at −40° C. Indeed, the available experimental evidence indicates that a number of such compositions have a kinematic viscosity of at least 6.8 cSt at 100° C. and a Brookfield viscosity of less than 20,000 cP at −40° C.

Besides possessing desirable viscosity characteristics, the compositions of this invention which are devoid of high molecular weight polymeric viscosity index improvers possess excellent shear stability. The results in the following table are typical. These results were obtained using the standard Turbo Hydra-matic Cycling Test procedure as described in the Dexron-II specifications.

TABLE

Shear Stability Per the Turbo Hydra-matic Cycling Test

| | Automatic Transmission Fluid | | |
|---|---|---|---|
| Test Cycles | This Invention | Commercial A | Commercial B |
| Fresh | 7.18 | 7.70 | 6.95 |
| 0 | 7.07 | 7.40 | 6.78 |
| 5,000 | 7.05 | 6.24 | 6.08 |
| 10,000 | 7.07 | 5.78 | 5.64 |
| 15,000 | 7.08 | 5.60 | 5.55 |
| 17,500 | 7.08 | 5.62 | 5.53 |
| 20,000 | 7.09 | 5.55 | 5.51 |

It will be readily apparent that this invention is susceptible to considerable modification in its practice. Accordingly, this invention is not intended to be limited by the specific exemplifications presented hereinabove. Rather, what is intended to be covered is within the spirit and scope of the appended claims.

We claim:

1. An oleaginous liquid composition comprising a major amount of hydrogenated poly-α-olefin oligomer fluid having a viscosity in the range of about 2 to about 10 cSt at 100° C., said oligomer fluid being formed by oligomerization of 1-alkene hydrocarbon having 6 to 20 carbon atoms in the molecule, and hydrogenation of the resultant oligomer, and minor amounts of at least the following:

A) hydrogenated poly-α-olefin oligomer fluid having a viscosity in the range of about 40 to about 120 cSt at 100° C., said oligomer fluid being formed by oligomerization of 1-alkene hydrocarbon having 6 to 20 carbon atoms in the molecule, and hydrogenation of the resultant oligomer; and B) antiwear/extreme pressure agent selected from phospho-dispersant, and phosphorus- and boron-containing ashless dispersant;

said oleaginous liquid composition being characterized by being devoid or essentially devoid of metal-containing components and by having:

(i) a kinematic viscosity of at least 5.5 cSt at 100° C. and a Brookfield viscosity of less than 20,000 cP at −40° C.; or (ii) a kinematic viscosity of at least 6.8 cSt at 100° C. and a Brookfield viscosity of less than 50,000 cP at −40° C.

2. A composition as claimed in claim 1 further characterized by having a kinematic viscosity of at least 6.8 cSt at 100° C. and a Brookfield viscosity of less than 20,000 cP at −40° C.

3. A composition as claimed in claim 1 further characterized by containing at most up to but not more than about 10 percent by weight of high molecular weight polymeric viscosity-index improver.

4. A composition as claimed in claim 1 further characterized by being devoid of high molecular weight polymeric viscosity index improver.

5. A composition as claimed in claim 1 wherein said antiwear/extreme pressure agent consists essentially of:

(1) at least one phosphorus-containing succinimide ashless dispersant, or (2) at least one phosphorus- and boron-containing succinimide ashless dispersant, or (3) a combination of (1) and (2).

6. A composition as claimed in claim 1 further characterized by having a kinematic viscosity of at least 6.8 cSt at 100° C. and a Brookfield viscosity of less than 20,000 cP at −40° C.

7. A composition as claimed in claim 1 further characterized by containing at most up to but not more than about 10 percent by weight of high molecular weight polymeric viscosity index improver.

8. A composition as claimed in claim 1 further characterized by being devoid of high molecular weight polymeric viscosity index improver.

9. A composition as claimed in claim 1 wherein said antiwear/extreme pressure agent comprises aliphatic hydrocarbyl-substituted succinimide of a mixture of cyclic and acyclic polyethylene polyamines having an approximate average overall composition falling in the range of from diethylene triamine through pentaethylene hexamine, said succinimide being heated with (1) at least one phosphorylating agent to form a phosphorus-containing succinimide ashless dispersant; or (2) either concurrently or in any sequence with at least one phosphorylating agent and at least one boronating agent to form a phosphorus- and boron-containing succinimide ashless dispersant.

10. A composition as claimed in claim 1 further characterized by having a kinematic viscosity of at least 6.8 cSt at 100° C. and a Brookfield viscosity of less than 20,000 cP at −40° C.

11. A composition as claimed in claim 1 further characterized by containing at most up to but not more than about 10 percent by weight of high molecular weight polymeric viscosity index improver.

12. A composition as claimed in claim 1 further characterized by being devoid of high molecular weight polymeric viscosity index improver.

13. A composition as claimed in claim 1 further comprising at least one phosphorus-containing substance selected from (1) one or more inorganic acids of phosphorus; or (2) one or more inorganic thioacids of phosphorus; or (3) one or more monohydrocarbyl esters of one or more inorganic acids of phosphorus; or (4) one or more monohydrocarbyl esters of one or more inorganic thioacids of phosphorus; or (5) any combination of any two, or any three or all four of (1), (2), (3), and (4); or at least one oil-soluble amine salt or complex or adduct of any of (1), (2), (3), (4), and (5), said amine optionally being in whole or in part an amine moiety in (i) a basic nitrogen-containing succinimide or (ii) a boron- and basic nitrogen-containing succinimide or (iii) a phosphorus- and basic nitrogen-containing succinimide or (iv) a phosphorus-, boron- and basic nitrogen-containing succinimide.

14. A composition as claimed in claim 13 further characterized by having a kinematic viscosity of at least 6.8 cSt at 100° C. and a Brookfield viscosity of less than 20,000 cP at −40° C.

15. A composition as claimed in claim 13 further characterized by containing at most up to but not more than about 10 percent by weight of high molecular weight polymeric viscosity index improver.

16. A composition as claimed in claim 13 further characterized by being devoid of high molecular weight polymeric viscosity index improver.

17. An additive concentrate comprising at least the following:

A. hydrogenated poly-α-olefin oligomer fluid having a viscosity in the range of about 40 to about 120 cSt at 100° C., said oligomer fluid being formed by oligomerization of 1-alkene hydrocarbon having 6 to 20 carbon atoms in the molecule, and hydrogenation of the resultant oligomer; and B) antiwear/extreme pressure agent selected from phosphorus-containing ashless dispersant and phosphorus- and boron-containing ashless dispersant;

said concentrate being characterized by (i) being devoid or essentially devoid of metal-containing components, and (ii) forming, when blended at at least one concentration below 10 percent by weight with hydrogenated poly-α-olefin oligomer fluid having a viscosity in the range of about 2 to about 10 cSt at 100° C. formed by oligomerization of 1-alkene hydrocarbon having 6 to 20 carbon atoms in the molecule, and hydrogenation of the resultant oligomer, a fluid composition having (a) a kinematic viscosity of at least 5.5 cSt at 100° C. and a Brookfield viscosity of less than 20,000 cP at −40° C., or (b) a kinematic viscosity of at least 6.8 cSt at 100° C. and a Brookfield viscosity of less than 50,000 cP at −40° C.

18. A composition as claimed in claim 17 further characterized in that said concentrate, when blended at one or more concentrations below 6 percent by weight in hydrogenated poly-α-olefin oligomeric fluid having a viscosity in the range of about 2 to about 10 cSt at 100° C., forms of fluid composition having a kinematic viscosity of at least 6.8 cSt at 100° C. and a Brookfield viscosity of less than 20,000 cP at −40° C.

19. A composition comprising a major proportion of at least one oil of lubricating viscosity containing a minor proportion of up to about 10% by weight of a concentrate as claimed in claim 17.

20. A composition comprising a major proportion of at least one oil of lubricating viscosity containing a minor proportion of up to about 10% by weight of a concentrate as claimed in claim 18.

* * * * *

UNITED STATES PATENT AND TRADEMARK OFFICE

CERTIFICATE OF CORRECTION

PATENT NO. : 5,089,156

DATED : February 18, 1992

INVENTOR(S) : Douglas R. Chrisope Et Al

It is certified that error appears in the above-identified patent and that said Letters Patent is hereby corrected as shown below:

Claim 1, column 21, line 38 reads "phospho-dispersant" and should read -- phosphorus-containing ashless dispersant -- .

Claim 6, column 21, line 67, reads "Claim 1" and should read -- Claim 5 -- .

Claim 7, column 22, line 3, reads "Claim 1" and should read -- Claim 5 -- .

Claim 8, column 22, line 7, reads "Claim 1" and should read -- Claim 5 -- .

Claim 10, column 22, line 23 reads "Claim 1" and should read -- Claim 9 -- .

Claim 11, column 22, line 27 reads "Claim 1" and should read -- Claim 9 -- .

Claim 12, column 22, line 31 reads "Claim 1" and should read -- Claim 9 -- .

Claim 13, column 22, line 34 reads "Claim 1" and should read -- Claim 9 -- .

Signed and Sealed this

Fifteenth Day of June, 1993

*Attest:*

Michael K. Kirk

MICHAEL K. KIRK

*Attesting Officer*

*Acting Commissioner of Patents and Trademarks*